United States Patent [19]

Hofmann, Jr.

[11] 4,302,160

[45] Nov. 24, 1981

[54] SILENTLY OPERATING FLUID PUMP UNIT

[76] Inventor: Rudolf Hofmann, Jr., c/o Sullair Europe Corporation, 2 Wallensteinstrasse 20, D-8192 Geretsried, Fed. Rep. of Germany

[21] Appl. No.: 62,891

[22] Filed: Aug. 1, 1979

[51] Int. Cl.[3] ..... F04B 39/00

[52] U.S. Cl. ..... 417/313; 62/507

[58] Field of Search ..... 417/234, 312, 313; 62/428, 507

[56] References Cited

U.S. PATENT DOCUMENTS

| | | | |
|---|---|---|---|
| 2,115,288 | 4/1938 | Smith | 62/428 |
| 2,892,324 | 6/1959 | Quick | 62/507 X |
| 3,478,958 | 11/1969 | Hinck et al. | 417/234 |
| 3,500,657 | 3/1970 | Johnson | 62/428 |
| 3,602,616 | 8/1971 | Jung | 418/206 X |
| 3,856,439 | 12/1974 | Moehrbach | 417/312 |
| 3,989,415 | 11/1976 | Van-Hee et al. | 417/312 |
| 4,022,550 | 5/1977 | Brink et al. | 417/234 |

FOREIGN PATENT DOCUMENTS

| | | |
|---|---|---|
| 2302046 | 7/1974 | Fed. Rep. of Germany . |
| 1127876 | 9/1968 | United Kingdom . |
| 1128020 | 9/1968 | United Kingdom . |

*Primary Examiner*—Carlton R. Croyle
*Assistant Examiner*—Edward Look
*Attorney, Agent, or Firm*—Wegner, Stellman, McCord et al.

[57] ABSTRACT

A fluid pump unit having a pump, a driving motor which may be air-cooled and various system components which require a cooling air stream includes a fan which is located between the motor and the pump approximately at the midpoint of the cooling air flow route. The air flow route is arranged to be as long as possible and is provided with sharp angular bends and sound-deadening barriers to limit noise transmission to the exterior of the housing. Air-cooled system elements are located between the fan and housing exterior to act as noise deadeners and further reduce noise transmission.

12 Claims, 3 Drawing Figures

SILENTLY OPERATING FLUID PUMP UNIT

BACKGROUND OF THE INVENTION

This invention pertains to a compressor unit having a housing which contains a motor, a fluid pump with auxiliary apparatus and a fan to circulate cooling air. In particular, this invention is to be used in conjunction with an oil-injected, screw-type compressor driven by an electric motor.

SUMMARY OF THE INVENTION

In compressor units of the type described above, the main noise generator—the circulating fan—is located near the housing air inlet or outlet making it difficult to limit the level of sound transmitted from the unit.

Compressor units are usually located indoors and in many instances, the noise level associated with such units may prove unacceptable. The addition of sound-deadening material or devices to the housing exterior is undesirable since the additional material may interfere with the proper flow of cooling air and will result in a bulkier overall unit which wastes valuable floor space.

An object of the invention is to provide a compact compressor unit in which the circulation fan is removed as far as possible from either the housing inlet or outlet to limit the level of sound transmitted directly to the atmosphere.

The invention disclosed herein accomplishes this object by locating the circulation fan between the drive motor and the compressor approximately in the center of the air flow route. This arrangement results in the longest possible sound transmission distance between the fan and the compressor unit air inlet and outlet.

In addition, the air intake route is provided with an air deflection shaft, which also serves as a base for the compressor unit, that diverts the flow of air as it travels to the fan thereby further reducing noise transmission. Equipment associated with the compressor, such as an air cooler, oil cooler or oil separator, are located within the air route and act as noise transmission barriers.

A compact construction is achieved by separating the motor and compressor to provide an open area which is utilized as the air flow route and to contain the above auxiliary equipment. Unit size is thereby determined by the dimensions of this auxiliary equipment only, as opposed to the dimensions of the equipment plus the dimensions of the air flow route.

Other aspects, objects and advantages may be obtained from study of the drawings, description and appended claims.

DESCRIPTION OF THE PREFERRED EMBODIMENT

Figure 1:
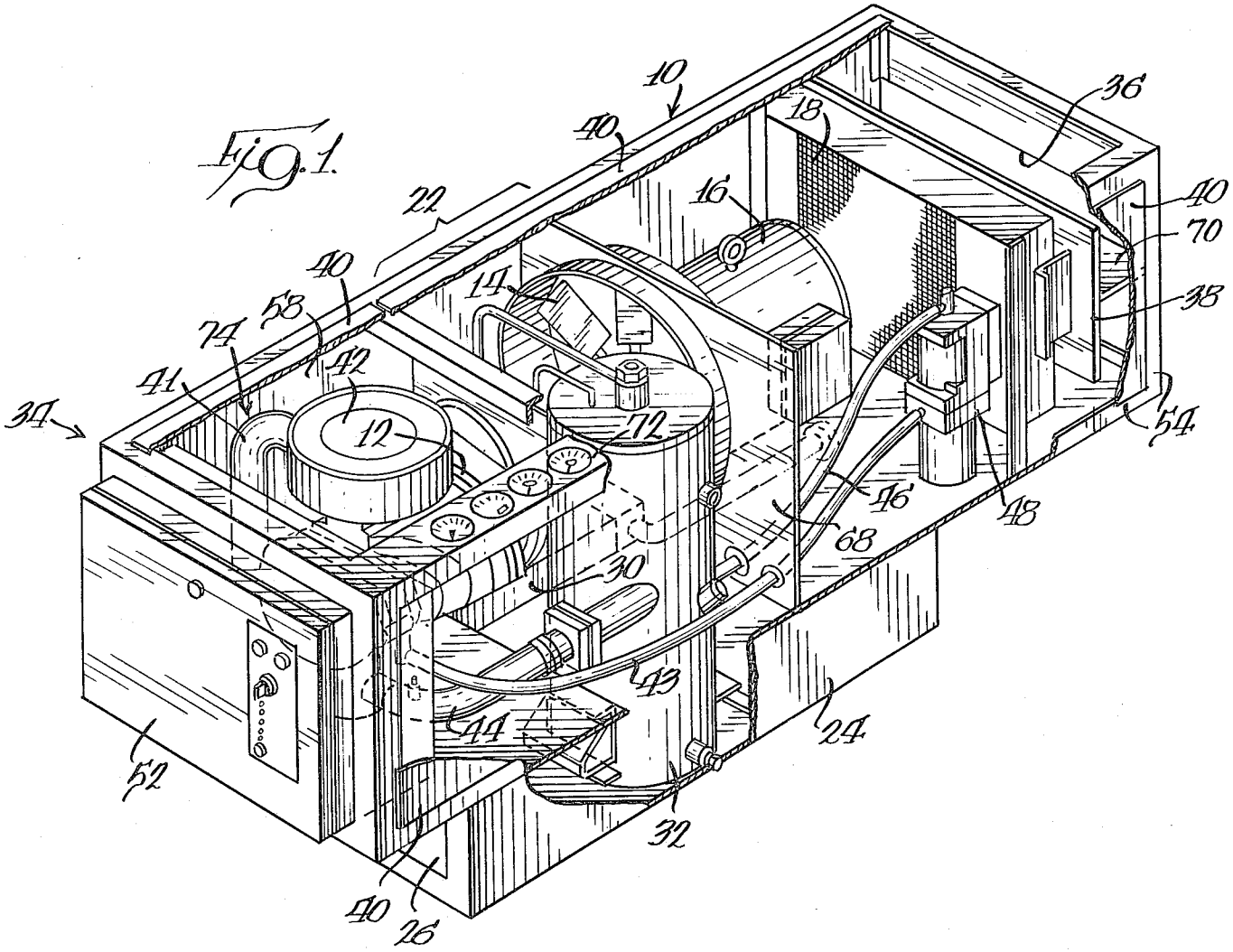
FIG. 1 is a perspective view of a compressor unit made according to one embodiment of the invention.
Figure 2:
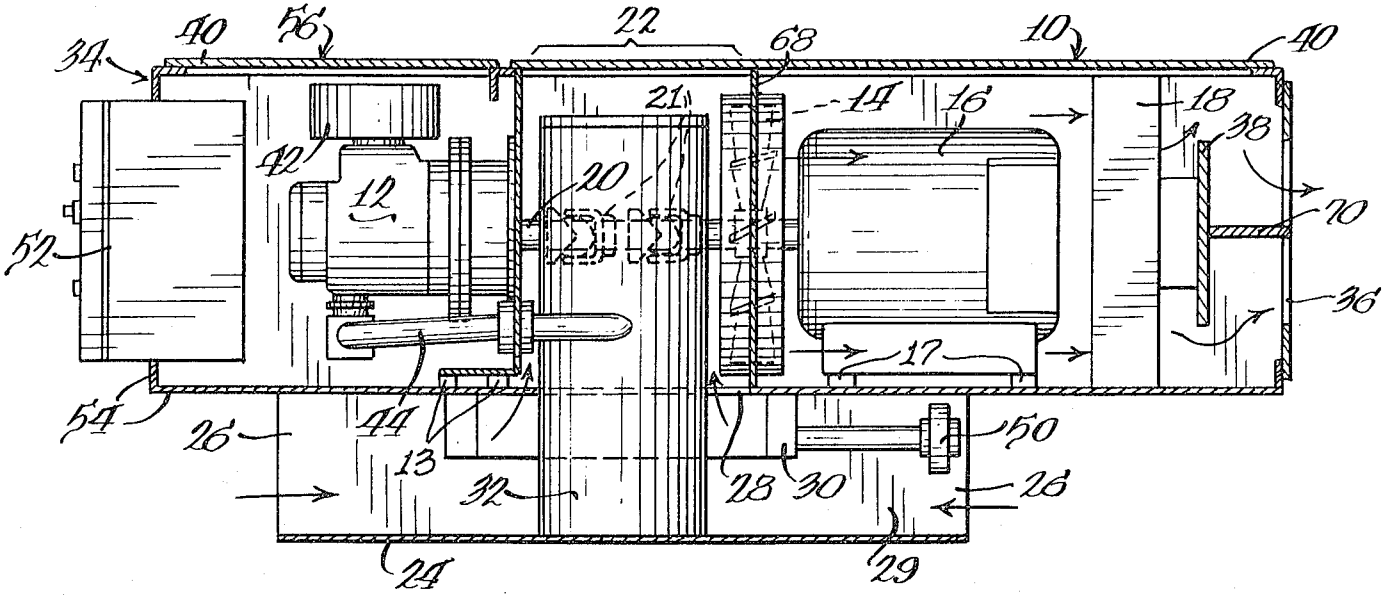
FIG. 2 is a sectional side elevation of the compressor unit of FIG. 1.

FIGS. 1 and 2 show a compressor unit having an elongated housing 10 which is rectangular in cross section. Within the housing 10, there is located a screw-type compressor 12, a circulating fan 14, an electric drive motor 16 and an oil cooler 18. The circulating fan 14 is located directly on an elongated motor drive shaft 20 which extends to the compressor 12.

As may be more easily seen in FIG. 2, the compressor 12 is located at some distance from the fan 14 and the motor 16 thereby forming an air chamber 22 which extends across the entire width of the housing 10.

The compressor 12 is also mounted within the housing 10 independently of the motor 16. The compressor 12 is secured to the housing 10 through pump mounting means 13 while the motor 16 is secured to the housing 10 through motor mounting means 17.

The housing 10 is located atop a hollow base 24 which extends the full width but not the complete length of the housing 10. Dual apertures 26 connect the interior of the base 24 to the atmosphere and permit air flow from the atmosphere to the interior of the base 24. The air chamber 22 is connected to the interior of the base 24 by an opening 28 in the lower surface of the housing 10. The housing opening 28 intersects the base 24 approximately at its midpoint forming two air shafts 29 which extend parallel to the axis of the housing 10 from the housing opening 28 to the base apertures 26.

Located within the chamber 22 is a compressed air aftercooler 30 and an oil separator 32. The aftercooler 30 extends in a plane parallel to the longitudinal axis of the housing 10 and at least partially across the opening 28 whereas the oil separator 32 extends vertically from the base 24 into the housing 10 and essentially occupies the combined height of the base 24 and housing 10.

The end 34 of the housing 10 nearest the compressor 12 is closed and an outlet opening 36 for the cooling air drawn in by the circulating fan 14 is formed on the opposite end. Cooling air is drawn from the atmosphere into the base 24, around the oil separator 32, and into the air chamber 22, through the aftercooler 30 and the housing opening 28. After passing through the fan 14, the cooling air is forced over the motor 16, through the oil cooler 18, and to the atmosphere through housing opening 36.

In a compressor unit driven by an electric motor 16, the chief noise generator is the circulating fan 14 which, in the embodiment shown in FIGS. 1 and 2, is located approximately at the midpoint of the cooling air flow route to provide long sound deadening paths for the noise generated. In addition to the sound reduction caused by the length of the flow route between the apertures 26 and the circulating fan 14, further reduction is achieved by deflecting the cooling air 90° as it enters the housing 10 from the base 24 and by again deflecting the air 90° as it passes from the air chamber 22 to the fan 14. Noise deadening on the intake side of the circulating fan 14 is further increased by locating the aftercooler 30 and the oil separator 32 within the air flow path.

On the exhaust side of the circulating fan 14, the noise deadening effect of the distance between the fan 14 and the opening 36 is accentuated by the intervening location of the motor 16 and the oil cooler 18.

Since noise transmission is particularly troublesome on the outlet side of the circulating fan 14, a deflection plate 38 is positioned inside the housing 10 adjacent the opening 36. This plate 38 not only absorbs noise in its own right, but also deflects the air stream toward the housing walls 40 where additional noise is absorbed.

The compressor 12, which is second only to the fan in generating noise, is oil-cooled and therefore need not be located within the air flow path. As such, the housing end 34 which contains the compressor 12 may be completely closed by the housing walls 40. Sealing the housing 10 around the compressor 12 further contributes to noise deadening.

Air to be compressed enters the compressor 12 through a conduit 41 and a filter 42. The compressor 12 is cooled by oil which is injected through a hose 43 and flows with the compressed air through a line 44 into the oil separator 32 which removes oil from the compressed air. Oil from the separator 32 is led by way of a hose 46 into the oil cooler 18 from which it flows back to the compressor 12. Located at the oil cooler 18 is an oil flow valve and filter combination 48 which controls the flow of cooling oil to the compressor 12. From the oil separator 32, compressed air cleaned of oil flows to the aftercooler 30 which is provided with an air system connector 50.

On the closed end 34 of the housing 10 there is arranged a control box 52 which contains the devices required for the operation of the compressor unit. The control box 52 may be located at any convenient position on the housing 10, but it is desirable to place the controls 52 on the closed end 34 of the housing 10 to provide an additional noise barrier between the compressor 12 and the atmosphere.

The housing 10 is formed by a frame 54 which is provided on its upper 56 and two side 58 surfaces with removable wall elements 40 as illustrated in FIG. 1. These wall elements 40 may be in one piece or several parts. By the removal of these wall elements, the entire compressor unit can be opened for servicing.

In the compressor unit illustrated by FIGS. 1 and 2, the compressor 12 and the motor 16 are connected by an extended drive shaft 20 to produce the air chamber 22. Because of the wide separation between these two elements, it is desirable that the drive shaft 20 be elastically yielding or contain universal joints 21 to compensate for assembly tolerance variations and to allow the motor 16 and compressor 12 to vibrate independently of each other.

Figure 3:
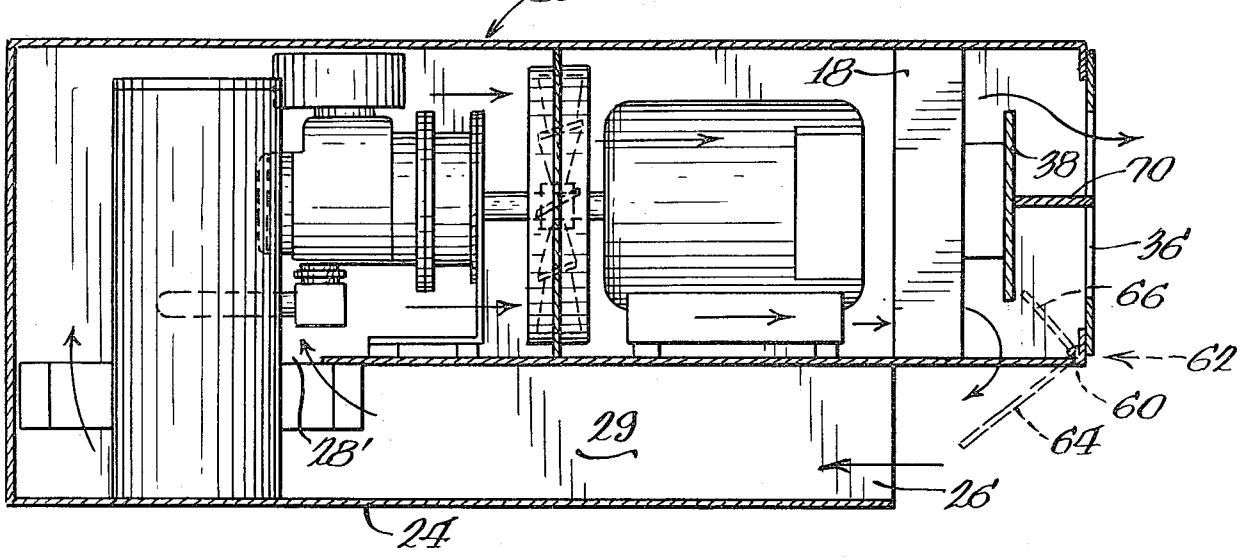
FIG. 3 is a side elevation of another embodiment of the invention showing the air flow route therethrough.

If the compressor unit is located outdoors, it may happen that the aftercooler 30 will freeze during operation. In order to prevent freezing, there is provided in the cooling air exit path an air diversion panel 60 which guides part of the heated air back to the aperture 26. As shown in FIG. 3, the panel 60 is L-shaped when viewed from the side and is shown by broken lines in the operating position, in which a maximum amount of heated air is deflected, and by solid lines in the non-operating position. The panel 60 is pivotally attached to the lower open end 62 of the housing 10 and one leg 64 forms a portion of the lower part of the housing 10. The other leg 66 is formed in such a way that in the illustrated operating position, it bears on the deflecting plate 38 and directs a partial stream of heated air into the aperture 26 located in the base 24. The lid 60 may be positioned intermediate the two illustrated positions to provide varying degrees of intake air preheat, and may be manually adjustable or controlled by a thermostat (not shown).

The successive arrangement of the aftercooler 30, the motor 16 and the oil cooler 18, results in a favorable utilization of the cooling air drawn into the circulating fan 14. A lesser amount of cooling air and smaller housing cross-sectional dimensions are achieved by this arrangement as compared to arrangements where the oil cooler 18 and the aftercooler 30 are located next to one another. In addition, the amount of cooling air which flows directly from the aperture 26 to the fan 14 may be varied by providing an aftercooler which completely or only partially covers the opening 28. The circulating fan 14 is located in a separating wall 68 which covers the area between the circumference of the fan 14 and the inside surface of the housing 10 to prevent the backflow of cooling air.

The above-described arrangement of a compressor unit results in maximum noise reduction and a most compact construction. Noise reduction is a result, on one hand, of the central arrangement of the circulating fan 14 within the housing 10 so that long deadening stretches are present before and after the circulating fan 14. On the other hand, noise reduction is achieved by muffling elements, such as the aftercooler 30, the oil separator 32 and the oil cooler 18, arranged in the flow path of the cooling air. Other factors which contribute to noise reduction are the multiple deflections of cooling air drawn in from the base 24 and the fact that the base 24 is shorter than the housing 10 so that the apertures 26 are covered by the protruding housing 10.

In addition to noise reduction achieved by the arrangement of the individual elements of the compressor unit and the design of the flow path of the cooling air, further noise muffling devices can be incorporated. The housing 10 is usually lined on the inside with a soundproofing material. A deflection plate (not shown) may be provided in air shaft 29, similar to plate 38 at opening 36. As shown in FIGS. 1 and 3, the deflection plate 38 is mounted on the oil cooler 18 and connected to the housing frame 54 by a brace 70 perpendicular to the plate 38. In order to obtain proper deflection of the cooling air, the height of the deflection plate 38 is greater than that of the outlet opening 36. The deflecting plate 38 may bear laterally on the side walls 40 of the housing 10.

Because of the low-height construction of the compressor unit, instruments 72 which must be observed during compressor operation, such as a manometer, a running-time meter or the like, are arranged on the upper surface of the housing 10.

It will be recognized that the cooling air apertures 26 may be located laterally on the base 24 as opposed to facing longitudinally as shown.

Another compressor unit is schematically illustrated in FIG. 3. In this unit, the opening 28' between the base 24 and the housing 10 is arranged approximately between the ends of the base 24 and the housing 10 so that cooling air flows around the compressor 12. In this arrangement, it is not necessary to separate the motor 16 and the compressor 12 a large distance from each other since the aftercooler 30 and the oil separator 32 can be arranged in this connection opening 28 at the end of the housing 10. In order to lengthen the noise-deadening distance between the fan 14 and the outlet 36, however, the circulating fan 14 is again placed between the motor 16 and the compressor 12.

Since the compressor unit of FIG. 3 has only a single aperture 26, the diversion panel 60 may be designed to cover only a portion of the width of the aperture 26. In constructions according to FIGS. 1 and 2, the panel 60 can extend across the entire width of the base 24 since cold air will be also drawn in through the opposite aperture 26. As indicated above, additional noise muffling elements such as deflection plate 38 may be arranged in the air shaft 29 of the base 24.

As illustrated in FIG. 1, the dead space 74 in the housing 10 which encloses the compressor 12, is open to the air chamber 22. In order to reduce the noise emanating from the compressor 12, the dead space 74 may be separated from other areas within the housing 10 by a separating wall (not shown).

According to another embodiment, the cross sectional area of the housing 10 can be determined by the dimensions of the oil cooler 18 and the aftercooler 30 which can be arranged side-by-side.

It will be recognized that the present invention is not limited to a compressor unit utilizing a screw-type air compressor. The subject matter of the invention may also advantageously be employed in a unit containing a vacuum pump or a hydraulic pump. In these cases, the pump will also be cooled by oil injection so that cooling air need not be employed to cool the pump unit. In such a unit, the aftercooler 30 for the compressed air would be omitted.

I claim:

1. A fluid pump unit having a hollow housing, at least one inlet and at least one outlet connecting the exterior of said housing to the hollow interior thereof, a pump and drive means to operate the pump both of which are disposed within the housing, comprising:

an oil separator coupled to said pump;

an aftercooler coupled to said oil separator;

an open ended air shaft for directing air to said inlet; and a fan located approximately at the midpoint of the air flow route for moving air through said housing from said inlet through said housing from said inlet to said outlet;

said oil separator and said aftercooler being located in said housing between said air shaft and said fan so as to limit the amount of noise transmitted to the exterior of the housing.

2. The fluid pump unit of claim 1 wherein said pump is mounted within said housing independently and at a distance from said drive means.

3. The fluid pump unit of claim 2 further including a universal joint connecting said pump and said drive means.

4. The fluid pump unit of claim 1, wherein said open ended air shaft forms a base which supports said housing.

5. The fluid pump unit of claim 1 wherein said housing further includes an air diversion panel movable between positions adjacent and spaced from said housing for guiding air from said outlet to said inlet when said panel is in said position spaced from said housing.

6. A fluid pump unit comprising:

a housing having a hollow interior;

at least one inlet in said housing connecting the exterior of said housing to said hollow interior;

at least one outlet in said housing connecting the exterior of said housing to said hollow interior;

a pump within said housing;

drive means to operate said pump;

means located within said housing approximately at the midpoint of the air flow route for moving air through said housing from said inlet to said outlet; and an open ended air shaft attached to said housing substantially perpendicular to the flow of air at said inlet to direct the flow of air to said inlet, wherein said air shaft forms a base which supports said housing.

7. The fluid pump unit of claim 6 wherein said housing inlet is located substantially at the longitudinal midpoint of said housing and intersects substantially the longitudinal midpoint of said base.

8. The fluid pump unit of claim 7 further including an oil separator coupled to said pump and an aftercooler coupled to said oil separator, said oil separator and said aftercooler being located between said air shaft and said fan.

9. The fluid pump unit of claim 8 wherein the combined height of said housing and said base is not substantially greater than the height of said oil separator.

10. The fluid pump unit of claim 6 wherein said housing inlet is located at an end of said housing and intersects an end of said base.

11. The fluid pump unit of claim 10 further including an oil separator coupled to said pump and an aftercooler coupled to said oil separator, said oil separator and said aftercooler being located between said air shaft and said fan.

12. The fluid pump unit of claim 11 wherein the combined height of said housing and said base is not substantially greater than the height of said oil separator.

* * * * *